United States Patent [19]

Koorneef et al.

[11] 4,197,482

[45] Apr. 8, 1980

[54] COLOR SELECTION MEANS FOR COLOR DISPLAY TUBE AND METHOD OF MAKING SAME

[75] Inventors: Jacob Koorneef; Antonius J. Der Kinderen, both of Eindhoven, Netherlands

[73] Assignee: U.S. Philips Corporation, New York, N.Y.

[21] Appl. No.: 946,720

[22] Filed: Sep. 28, 1978

[30] Foreign Application Priority Data

Oct. 27, 1977 [NL] Netherlands ..... 7711773

[51] Int. Cl.[2] ..... H01J 9/14; H01J 29/07

[52] U.S. Cl. ..... 313/403; 29/25.17; 313/408

[58] Field of Search ..... 313/402, 403, 408, 348, 313/350, 355, 357; 29/25.17

[56] References Cited

U.S. PATENT DOCUMENTS

| | | | |
|---|---|---|---|
| 3,112,421 | 11/1963 | Raibourn et al. | 313/350 X |
| 4,059,781 | 11/1977 | Van Alphen et al. | 313/403 |
| 4,066,923 | 1/1978 | Van Esdonk | 313/403 X |
| 4,107,569 | 8/1978 | Ronde | 313/402 |
| 4,121,131 | 10/1978 | Van Esdonk et al. | 313/403 X |
| 4,135,111 | 1/1979 | Verweel | 313/403 |

*Primary Examiner*—Palmer C. Demeo

*Attorney, Agent, or Firm*—Algy Tamoshunas

[57] ABSTRACT

A color display tube having a quadrupole post-focusing electrode consisting of two crossing sets of parallel conductors, the first set of conductors consisting of wires and the second set of conductors consisting of metal stripes secured pairwise against each other and clamping the wires at the crossings, said wires being surrounded coaxially at the area of the crossings by a layer of insulation material, has the advantage that already at a comparatively low focusing voltage between the sets of conductors a sufficiently strong focusing influence is exerted on the electron beams.

4 Claims, 7 Drawing Figures

COLOR SELECTION MEANS FOR COLOR DISPLAY TUBE AND METHOD OF MAKING SAME

Figure 1:
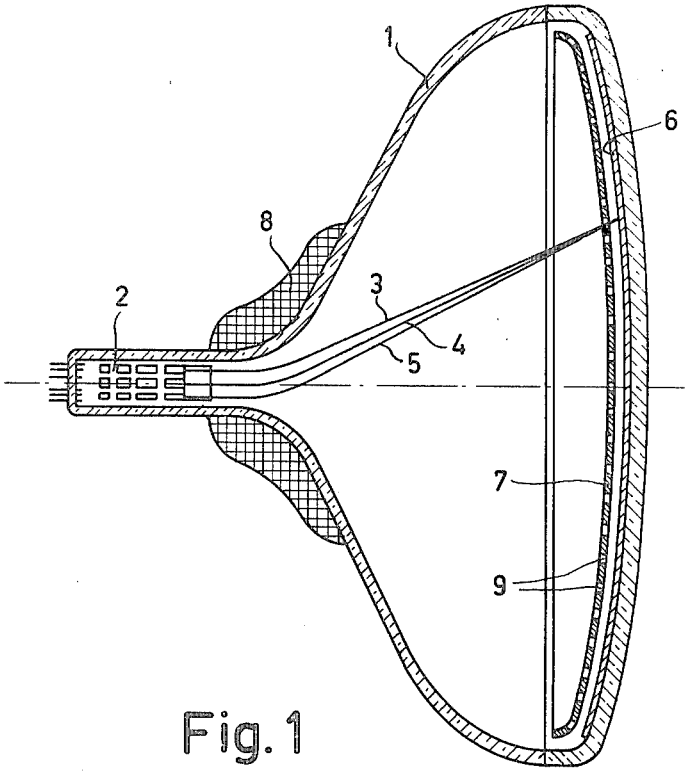

The invention relates to a colour display tube comprising, in an evacuated envelope, means for generating a plurality of electron beams, a display screen comprising a large number of regions luminescing in different colours, and colour selection means having a large number of apertures which assign each electron beam to luminescent regions of one colour. The colour selection means is comprised of a grid formed by two crossing sets of parallel conductors which are insulated from each other at the crossings with the conductors of each set being interconnected.

The invention also relates to a method of manufacturing such a colour display tube.

Such a colour display tube of the post-focusing type is disclosed in Netherlands Patent Application No. 7,409,642 laid open to public inspection which corresponds to U.S. Pat. No. 4,059,781.

The object of post-focusing is to increase the brightness of the display picture by increasing the transmission of the colour selection means. In tubes without post-focusing a very large part, for example 80–85%, of the electrons is intercepted by the so-called shadow-mask. By using post-focusing, the apertures in the colour selection means can be enlarged since, as a result of the focusing in the apertures, the electron spots on the screen are considerably smaller than the apertures so that despite the larger aperture size there is nevertheless sufficient landing tolerance. In the above cited patent application, electrostatic lenses are formed in the apertures of the shawdow mask which focus the electron beams in one direction and defocus them in the direction normal thereto. In one embodiment of this known tube, the colour selection means is formed by a grid consisting of two crossing sets of parallel conductors, the conductors being insulated from each other at the crossings and the conductors of each set being interconnected.

One characteristic of this known construction is that it consists of three, superposed layers, namely two conductive layers with an insulating layer therebetween. Upon aplication of a potential difference between the two sets of conductors, an electrostatic lens is formed which converges the electron beam in one direction and it diverges in the direction normal thereto. The lens strength, however, is restricted by the thickness of the insulating layer. In the known construction with conductors having a thickness of 50 μm and a thickness of the insulating material of 125 μm, the focusing voltage must, therefore, be approximately 1,000 Volts for a colour selection means positioned at approximately 9 mms from the display screen with square apertures having a width of 500 μm and a mutual pitch of 750 μm.

It is the object of the invention to provide a colour display tube of the post-focusing type in which the electron lenses formed in the apertures of the colour selection means are as strong as in the above described construction with a smaller potential difference between the sets of conductors.

According to the invention, a colour display tube of the kind mentioned in the preamble is characterized in that the conductors of the first set are wires and the conductors of the second set are formed by pairs of metal strips which are secured to each other and which clamp the wires at the crossings. The wires are being surrounded coaxially at the area of the crossings with a layer of insulating material. The electron lenses formed by this arrangement are stronger because in this construction the electrodes generating the quadrupole field are situated in one plane.

One advantage of this construction is that it requires a lower focusing voltage of approximately 650 Volts with the colour selection means of the invention located at a distance of likewise, 9 mm from the display screen and having square apertures with a width of 500 μm and a mutual pitch of 750 μm. As a result, fewer electric flash-overs or arcs will occur between the two sets of conductors.

In a preferred embodiment of the invention the conductors are made of a soft-magnetic material, for example iron, so that a good magnetic screening is obtained, and the insulating material is aluminium oxide. It is alternatively possible to use glass ceramics, glasses or synthetic resins, for example polyamides, as an insulating material.

In accordance with a preferred method of making the colour display tube of the invention, a set of wires covered with insulation material are supported in a spaced apart, parallel relationship and a set of parallel metal strips or bands is provided on either side of the set of wires. The metal bands are oriented so that they are normal to the wires with the bands on one side of the wires being positioned opposite to the bands disposed on the other side. Thereafter after pairs of opposite bands are secured together so as to surround and clamp the insulated wires therebetween and the insulating material on the portions of the wires disposed between the crossings is removed. The removal of the excess insulation, for example aluminium oxide, is preferably carried out by means of etching. The removal, however, may alternatively be carried out by means of compressed air, a flow of liquid or powder jets.

Figure 2:
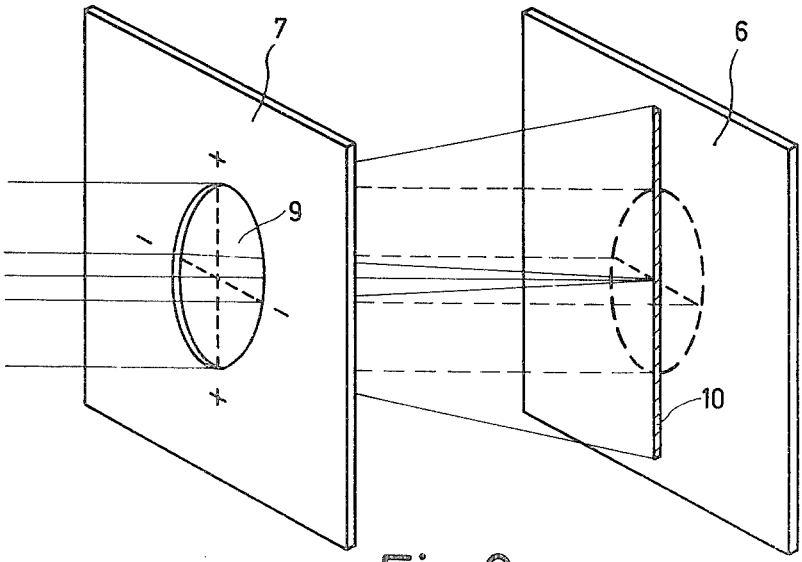
Figure 3:
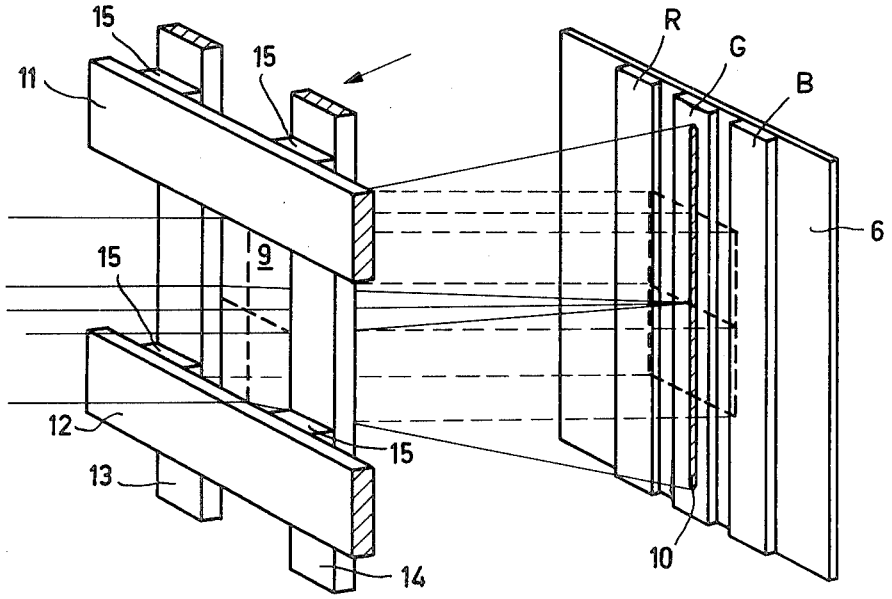
Fig. 3 PRIOR ART
Figure 4:
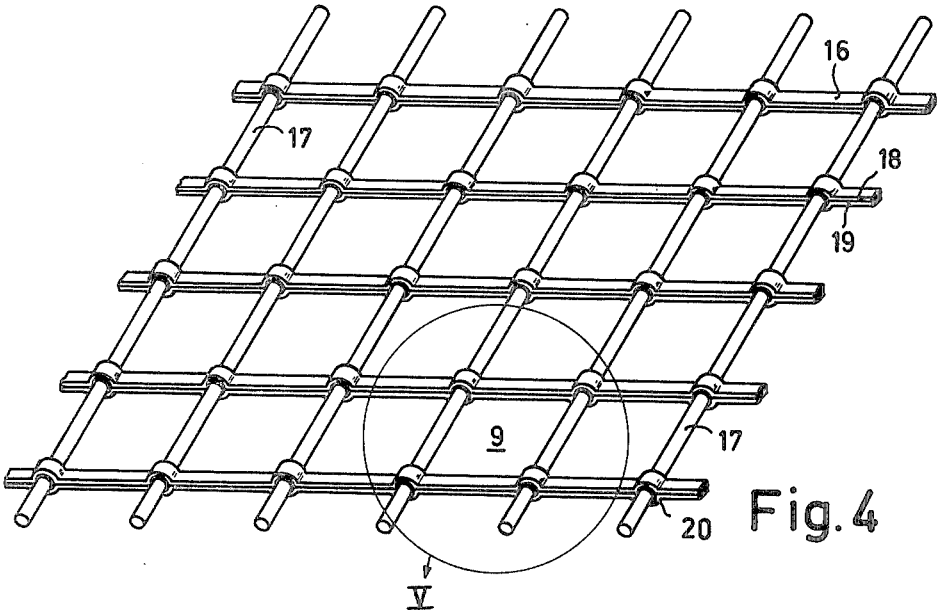
Figure 5:
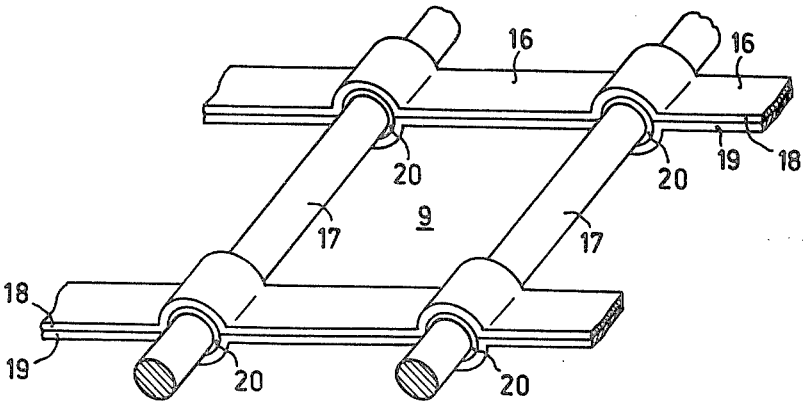
Figure 6:
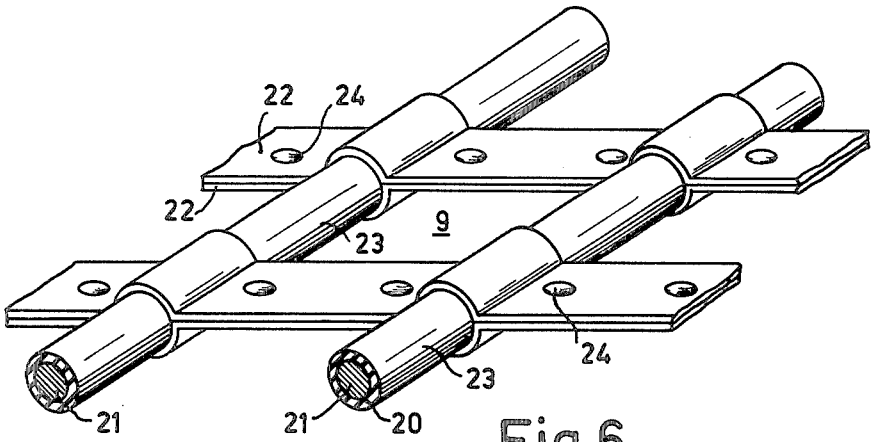
Figure 7:
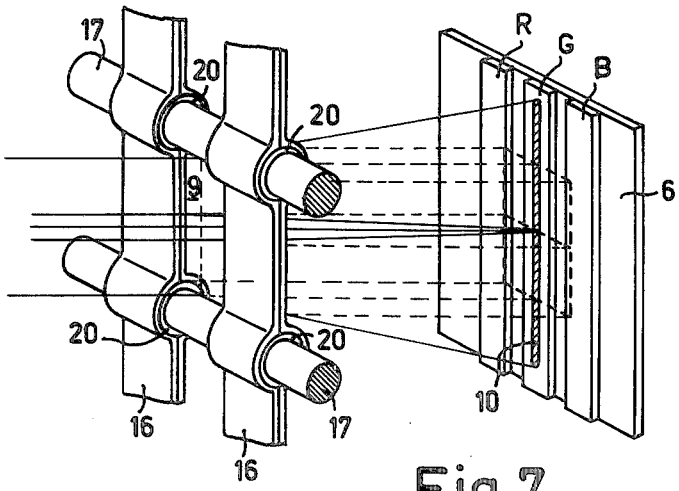

The invention will now be described in greater detail with reference to the accompanying drawing, in which:

FIG. 1 is a sectional view of a colour display tube according to the invention, FIG. 2 explains in detail the principle of quadrupole post-focusing, FIG. 3 is a perspective view of a known embodiment of a part of the colour selection means, FIGS. 4 and 5 are perspective views of a part of colour selection means according to the invention, FIG. 6 explains in detail the method of manufacturing the colour selection means according to the invention, and FIG. 7 explains the operation of the colour selection electrode according to the invention.

The display tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips luminescing in red, green and blue whose longitudinal direction is normal to the plane of the drawing of FIG. 1. During normal operation of the tube the phosphor strips are vertical and FIG. 1, hence, represents a horizontal sectional view of the tube. The colour selection means 7 has a large number of apertures 9 which are shown diagrammatically in FIG. 1. The three electron beams 3, 4 and 5 pass through the apertures 9 at a small angle to each other and consequently each impinges only on phosphor strips of one colour. The apertures 9 in the colour selection means 7 are thus very accurately positioned with respect to the phosphor strips of the display screen 6. An electron lens is formed in each aperture 9, as diagrammatically illustrated in FIG. 2 which shows a portion of the colour selection means 7 and one of the apertures 9. The potential variation along the edge of the aperture 9, denoted by +, −, +, −, to such that a quadrupole field is formed in the aperture. The electron beam, which passes through the aperture 9, is focused in the vertical plane, so that, when the display screen is exactly at the horizontal focus, the electron spot 10 is formed on the screen.

It is advantgeous not to focus the beam exactly on the display screen 6 so that a slightly wider electron spot is obtained. It is only of minory influence on the focusing when the electron beam passes through the aperture 9 at a small angle: as a result of this the colour selection of the three electron beams 3, 4 and 5 takes place quite analogously to that in the known shadow mask tubes without post-focusing. As a result of the strong focusing, however, the aperture 9 can be much larger than in the known shadow mask tubes without post-focusing so that much more electrons impinge upon the display screen 6 and a considerably brighter picture is formed. The defocusing in the vertical direction is not objectionable since the phosphor strips extend parallel to the longitudinal direction of the spot 10.

FIG. 3 shows prior art colour selection means. The colour selection means 7 is formed by two crossing sets of parallel conductors. FIG. 3 shows the horizontal conductors 11 and 12 of the first set and the vertical conductors 13 and 14 of the second set conductors 11, 12, 13 and 14 define one of the apertures 9 and are insulated from each other by means of insulating material 15. The three phosphor strips associated with the aperture 9 shown on the display screen 6 and are denoted by R (red), G (green) and B (blue). The rays of the central electron beam 4, only a few of which are shown in the Figure, form an electron spot 10 on the phosphor strip 9. The horizontal conductors, inter alia 11 and 12, are interconnected and are at a higher potential than the interconnected vertical conductors, inter alia 13 and 14, so that an electron lens, shown diagrammatically in FIG. 2, is formed in each aperture 9. However, the lens strength is limited by the thickness of the insulation material 15.

It is the object of the invention to provide a construction in which a lens of a strength equally to that of the known embodiment is obtained with a smaller voltage difference between the conductors.

Such a construction and a method of making it will now be described with reference to the following Figures.

FIGS. 4 and 5 are perspective views of a part of the colour selection means according to the invention. The colour selection means comprises two sets of parallel conductors 16 and 17. The conductors 16 are each comprised of two metal stripes 18 and 19 which are 75 μm thick and are secured to each other. The conductors may be secured to each other, for example, with a metal adhesive, diffusion by spot-welding. The strips 18 and 19 clamp the conductors 17 which are covered at the crossings by insulating material 20, for example aluminium oxide. In this manner two sets of parallel cnductors are formed which extend at right angles to each other. The conductors 16 and 17 are situated in one plane and together define the walls of the apertures 9 so that a strong quadrupole lens is obtained.

A suitable method for making such colour selection means will now be explained with reference to FIG. 6. A set of parallel wires 21 coated with insulating material 20 is supported in a holder (not shown). On either side of the set of wires, a set of parallel metal bands 22 is positioned in a manner such that the bands on one side of the set of wires are situated opposite to the bands on the other side of the wires. Therefore the bands disposed opposite each other are secured together by means of spot-welds 24, so that they clamp the insulated conductors at the crossings. The insulating material on the portions of the wires disposed between the crossings is then removed, for example, by means of etching.

FIG. 7 is a perspective view of a part of colour selection means used in colour display tubes according to the invention.

Colour selection means having square apertures with a width of 500 μm and a mutual pitch of 750 μm (and an electron transmission of approximately 44%) is mounted approximately 9 mm in front of the display screen 6. With a potential of 25 kV applied to the display screen 6, which is covered with the usual aluminium film, a potential of 25.4 kV applied to the conductors 17 and a potential of 24.75 kV on the conductors 16, the focal distance of the quadrupole lenses is approximately 13 mms in the center of the display screen with normal incidence. The distance from the colour selection means 7 to the display screen 6 is approximately 9 mms so that the focal point of the four quadrupole lenses lies everywhere just slightly beyond the display screen. This prevents that a so-called focusing ring from being visible on the display screen. The electron spots 10 are approximately 0.10 mm wide in the center of the display screen and approximately 0.09 mm wide in the corners. A suitable width for the phosphor strips R, G and B is 0.13 mm. The remainder of the surface of the display screen 6 may or may not be covered with a light-absorbing material.

A display screen for a tube according to the invention can be made by known exposure methods in which the colour selection means are reproduced on a photosensitive layer on a window portion of the tube. Because of the large transmission of the colour selection means of the invention, the exposure method used should be capable of producing phosphor strips narrower than the apertures 9. An exposure method suitable for this purpose uses two or more light sources at some distance from each other, as described in German Patent Application No. 2,248,878. Of course the display screen for a tube according to the invention may also be made by electronic exposure in which the sensitive layer on the window portion is "exposed" by an electron beam.

What is claimed is:

1. In a colour display tube including, in an evacuated envelope, means for generating a plurality of electron beams, a display screen having a multiplicity of regions luminescing in different colours and colour selection means for assigning each electron beam to luminescent regions of one colour, said colour selection means including two sets of parallel, spaced conductors, the conductors of each set being interconnected and the conductors of one set extending transversely of the conductors of the other set to define a grid with apertures for passing said beams, the improvement wherein said conductors of one of said sets are wires and said conductors of the other set are formed by pairs of metal strips secured to each other and clamping said wires therebetween at locations at which said wires cross said strips, and including an insulating layer disposed about portions of said wires which are clamped between said strips for insulating said conductors of the respective sets from each other.

2. The tube according to claim 1 wherein said insulating layer is aluminum oxide and said conductors are made of iron.

3. A method of making a colour selection means for a colour display tube comprising the steps of:

supporting a set of wires coated with an insulating material in a spaced apart, parallel relationship;

positioning, on each of two opposite sides of said set of wires, a set of spaced apart, parallel metal strips so that said strips extend perpendicularly to said wires with the strips of one set being disposed opposite the strips of the other set;

securing together opposite pairs of strips so that said wires are clamped therebetween to thereby form a grid of crossing conductors; and removing said insulation from portions of said wires which are not clamped between said strips.

4. The method according to claim 3 wherein said insulation is removed by etching.

* * * * *